US011774131B2

(12) United States Patent
Wang et al.

(10) Patent No.: US 11,774,131 B2
(45) Date of Patent: Oct. 3, 2023

(54) HEAT EXCHANGE SYSTEM FOR OUTDOOR UNIT OF AIR CONDITIONER AND AIR CONDITIONER

(71) Applicant: Guangdong Giwee Technology Co. Ltd., Foshan (CN)

(72) Inventors: Yuxian Wang, Foshan (CN); Pudun Guo, Foshan (CN)

( * ) Notice: Subject to any disclaimer, the term of this patent is extended or adjusted under 35 U.S.C. 154(b) by 0 days.

(21) Appl. No.: 17/380,651

(22) Filed: Jul. 20, 2021

(65) Prior Publication Data

US 2022/0034545 A1 Feb. 3, 2022

(30) Foreign Application Priority Data

Jul. 30, 2020 (CN) ..... 202010752843.2

(51) Int. Cl.

| | |
|---|---|
| ***F24F 11/84*** | (2018.01) |
| ***F24F 1/16*** | (2011.01) |
| ***F24F 1/32*** | (2011.01) |
| ***F24F 11/89*** | (2018.01) |

(52) U.S. Cl.

CPC ..... *F24F 11/84* (2018.01); *F24F 1/16* (2013.01); *F24F 1/32* (2013.01); *F24F 11/89* (2018.01)

(58) Field of Classification Search

CPC .... F24F 11/84; F24F 1/32; F24F 11/89; F24F 2005/0025; F24F 5/0021; F24F 11/873; F24F 11/875; F24F 1/00077

See application file for complete search history.

(56) References Cited

FOREIGN PATENT DOCUMENTS

| | | | | |
|---|---|---|---|---|
| CN | 201662273 | U | | 12/2010 |
| CN | 103383157 | A | * | 11/2013 |
| CN | 103383157 | A | | 11/2013 |
| CN | 104697251 | A | | 6/2015 |
| CN | 104764112 | A | | 7/2015 |
| CN | 105485988 | A | | 4/2016 |
| CN | 110469969 | A | | 11/2019 |
| CN | 111076446 | A | | 4/2020 |

(Continued)

OTHER PUBLICATIONS

JPS5895140A Translation (Year: 1981).*

(Continued)

*Primary Examiner* — Schyler S Sanks

(74) *Attorney, Agent, or Firm* — CANTOR COLBURN LLP

(57) ABSTRACT

A heat exchange system includes an outdoor unit heat exchange assembly, a first circulation pipeline, a control valve assembly, a heating pipeline and a heating assembly, wherein the outdoor heat exchange assembly includes a coolant heat radiation module and fins; the first circulation pipeline includes an output pipe, a connecting pipe and a return pipe; the output pipe communicates with an air conditioner indoor unit and the coolant heat radiation module; the connecting pipe communicates with the coolant heat radiation module and the fins; the return pipe communicates with the fins and the air conditioner indoor unit; the control valve assembly is connected with the output pipe; the heating pipeline communicates with the output pipe and the fins, communicates with the return pipe, and is also connected with the control valve assembly; and the heating assembly is connected with the heating pipeline.

8 Claims, 2 Drawing Sheets

(56) References Cited

FOREIGN PATENT DOCUMENTS

| | | | | |
|---|---|---|---|---|
| GB | 2545112 | A | | 6/2017 |
| JP | S5895140 | A | * | 11/1981 |
| JP | H1172277 | A | | 3/1999 |
| JP | 2010121847 | A | * | 6/2010 |
| JP | 2010121847 | A | | 6/2010 |

OTHER PUBLICATIONS

CN-103383157-A Translation (Year: 2013).*
JP-2010121847-A Translation (Year: 2010).*
European Search Report for Application No. 201188041.4; dated Jan. 4, 2022; 8 Pages.
Chinese Office Action for Application No. 202010752843.2; dated Jun. 9, 2021; 8 Pages.

* cited by examiner

HEAT EXCHANGE SYSTEM FOR OUTDOOR UNIT OF AIR CONDITIONER AND AIR CONDITIONER

FOREIGN PRIORITY

This application claims priority to Chinese Patent Application No. 202010752843.2, filed Jul. 30, 2020, and all the benefits accruing therefrom under 35 U.S.C. § 119, the contents of which in its entirety are herein incorporated by reference.

TECHNICAL FIELD

The present invention relates to the technical field of air conditioners, and more particularly relates to a heat exchange system for an outdoor unit of an air conditioner and an air conditioner.

BACKGROUND

In some areas, when an air conditioner operates to generate heat in winter, the heat absorption temperature of a heat exchanger for an outdoor unit of an air conditioner is reduced, and fins of the heat exchanger for the outdoor unit of the air conditioner are frosted, so that the heat exchange efficiency of the heat exchanger is lowered, and the performance of the air conditioner is reduced. Therefore, when an outdoor unit of an air conditioner is frosted, defrosting is required. Most outdoor units adopt a method of reversing a compressor to enable a heat exchange system to refrigerate, so that high-temperature coolant flows through the heat exchanger of the outdoor unit, but frequent reversing the compressor may damage user experience and shorten the service life of the air conditioner, and a heating effect is easily influenced in the defrosting process.

SUMMARY

The present invention is mainly directed to provide a heat exchange system for an outdoor unit of an air conditioner and an air conditioner, and aims at solving the technical problem of damaging user experience and shortening service life of an air conditioner due to frequent reversing of a compressor in a defrosting process in the prior art.

The present invention provides a heat exchange system for an outdoor unit of an air conditioner including: an outdoor unit heat exchange assembly including a coolant heat radiation module and fins; a first circulation pipeline including an output pipe, a connecting pipe and a return pipe, wherein the output pipe communicates with an air conditioner indoor unit and the coolant heat radiation module, the connecting pipe communicates with the coolant heat radiation module and the fins, and the return pipe communicates with the fins and the air conditioner indoor unit; a control valve assembly connected with the output pipe and controlling an opened-closed state of the first circulation pipeline; a heating pipeline communicating with the output pipe and the fins, communicating with the return pipe, and further connected with the control valve assembly, wherein the control valve assembly controls an opened-closed state of the heating pipeline; and a heating assembly connected with the heating pipeline and configured to heat a coolant in the heating pipeline before entering the fins.

In the heating process, the first circulation pipeline is opened through, and in the defrosting process, the first circulation pipeline and the heating pipeline are both opened through, and the heating assembly is started.

Further, the control valve assembly includes: a first valve connected with the output pipe and configured to control an opened-closed state of the output pipe; and a second valve connected with the heating pipeline and configured to control an opened-closed state of the heating pipeline.

One end of the connecting pipe is connected with the coolant heat radiation module, the other end of the connecting pipe is connected with the heating pipeline, the connecting pipe communicates with the fins through the heating pipeline, and the heating pipeline communicates with the return pipe through the fins.

Further, the heating assembly is connected between the second valve and the fins.

Further, the first valve and the second valve are stop valves.

Further, the control valve assembly includes: a third valve connected with the output pipe and the heating pipeline at the same time and configured to respectively control opened-closed states of the output pipe and the heating pipeline.

Further, the heating pipeline includes a first heating pipeline, a cooling connecting pipeline and a cooling refluxing pipeline.

The first heating pipeline communicates with the third valve and the fins; the first heating pipeline communicates with the cooling connecting pipeline through the fins; the cooling connecting pipeline communicates with the fins and the coolant heat radiation module; the cooling connecting pipeline communicates with the cooling refluxing pipeline through the coolant heat radiation module; and the cooling refluxing pipeline communicates with the coolant heat radiation module and the return pipe.

Further, the exchange system for the outdoor unit of the air conditioner further includes a fourth valve, wherein the cooling refluxing pipeline communicates with the return pipe through the fourth valve, and the fourth valve controls an opened-closed state of the cooling refluxing pipeline.

Further, the fourth valve is a reversing valve.

Further, the third valve is a reversing valve.

Further, the present invention further provides an air conditioner including a controller, an air conditioner indoor unit, an air conditioner outdoor unit and the exchange system for the outdoor unit of the air conditioner.

The controller is in communication connection and controls the control valve assembly.

The outdoor unit heat exchange assembly is included in the outdoor unit.

The indoor unit includes a pressure pump, an output end of the pressure pump communicates with the output pipe, and an input end of the pressure pump communicates with the return pipe.

The present invention has the beneficial effects that the exchange system for the outdoor unit of the air conditioner controls opened-closed states of the first circulation pipeline and the heating pipeline through the control valve assembly, by cooperating with the heating assembly, it can provide a high-temperature coolant for the fins in the heating process, can achieve a better defrosting effect while ensuring a heating effect, and can eliminate the need for frequently reversing the compressor. The technical problem of damaging user experience and shortening service life of the air conditioner due to frequent reversing of the compressor in the prior art can be solved.

The implementation of the objectives, the functional features and the advantages of the present invention will be further explained with reference to the accompanying drawings.

DETAILED DESCRIPTION OF THE INVENTION

It shall be understood that specific embodiments described herein are merely used to illustrate the present invention, and are not intended to limit the present invention.

Figure 1:
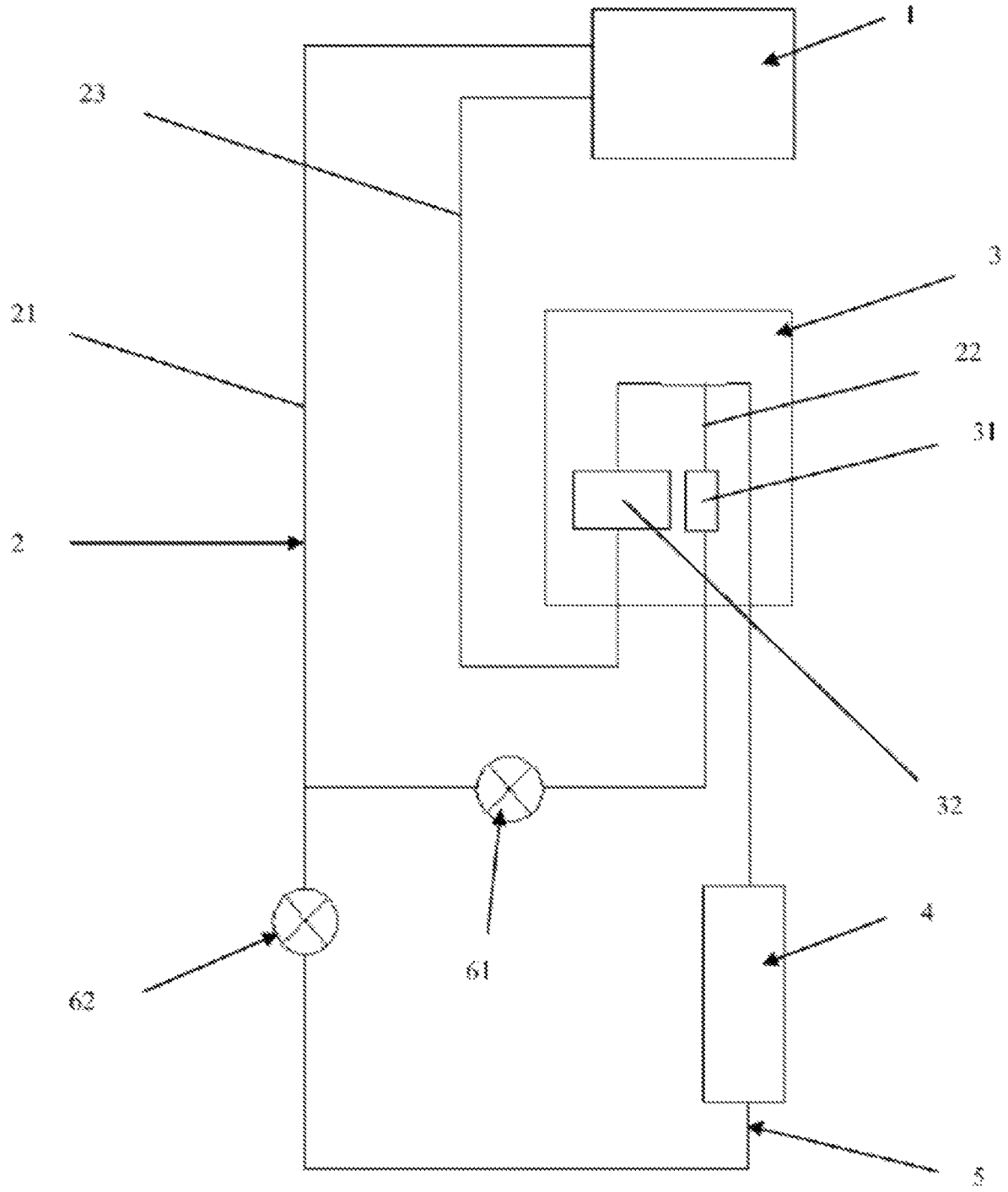
FIG. 1 is a schematic structure diagram of an embodiment of a heat exchange system for an outdoor unit of an air conditioner of the present application.
Figure 2:
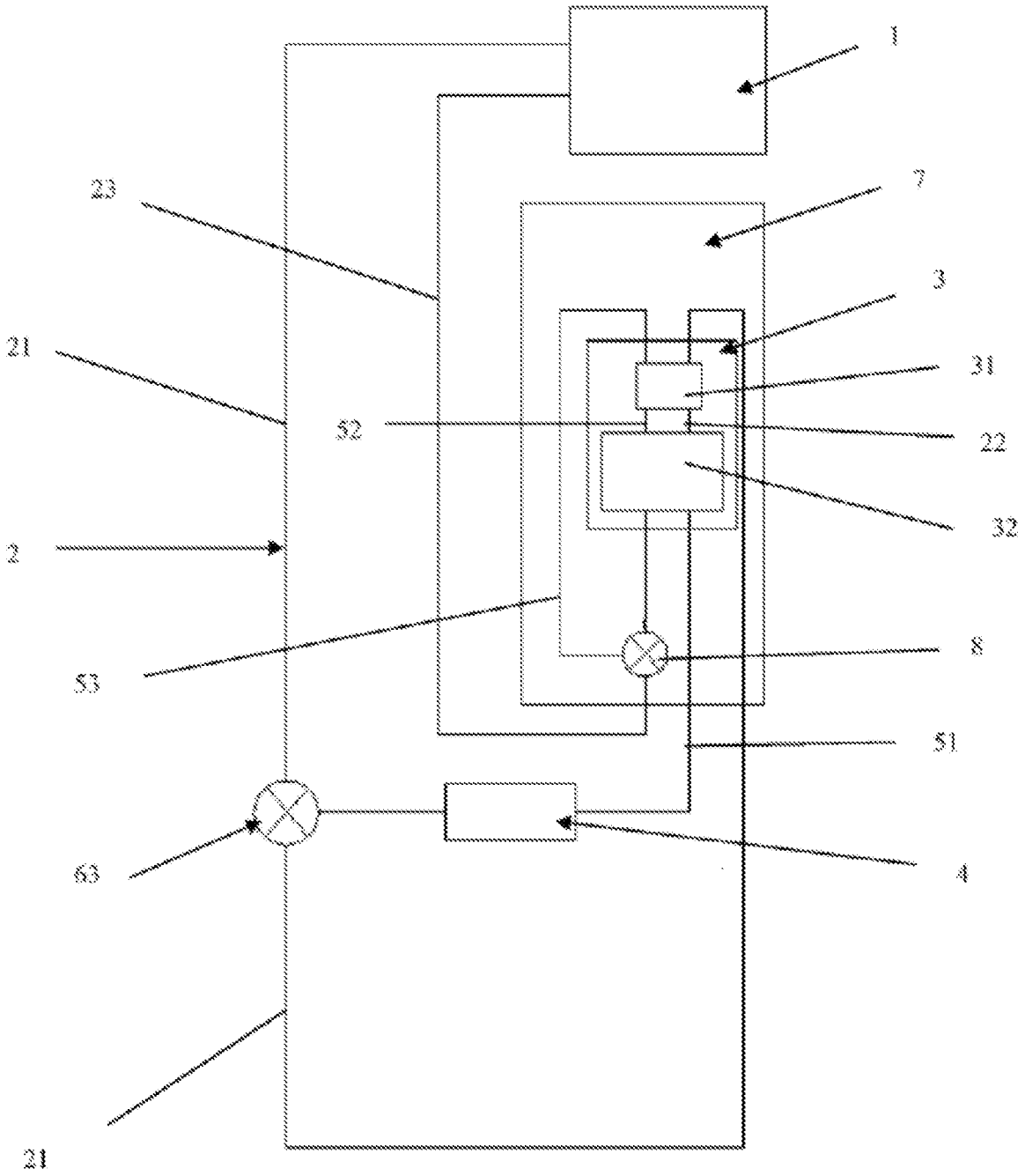
FIG. 2 is a schematic structure diagram of another embodiment of a heat exchange system for an outdoor unit of an air conditioner of the present application.

Referring to FIG. 1 to FIG. 2, the present invention provides a heat exchange system for an outdoor unit of an air conditioner including an outdoor unit heat exchange assembly 3, a first circulation pipeline 2, a control valve assembly, a heating pipeline 5 and a heating assembly 4. The outdoor unit heat exchange assembly 3 is disposed at an air conditioner outdoor unit 7. The outdoor unit heat exchange assembly 3 includes a coolant heat radiation module 31 and fins 32. The first circulation pipeline 2 includes an output pipe 21, a connecting pipe 22 and a return pipe 23. The output pipe 21 communicates with an air conditioner indoor unit 1 and the coolant heat radiation module 31, the connecting pipe 22 communicates with the coolant heat radiation module 31 and the fins 32, and the return pipe 23 communicates with the fins 32 and the air conditioner indoor unit 1. The control valve assembly is connected with the output pipe 21, and controls an opened-closed state of the first circulation pipeline 2. The heating pipeline 5 communicates with the output pipe 21 and the fins 32, communicates with the return pipe 23, and is also connected with the control valve assembly. The control valve assembly controls an opened-closed state of the heating pipeline 5. The heating assembly 4 is connected with the heating pipeline 5, and is configured to heat a coolant in the heating pipeline 5 before entering the fins 32. In the heating process, the first circulation pipeline 2 is opened through, and in the defrosting process, the first circulation pipeline 2 and the heating pipeline 5 are both opened through, and the heating assembly 4 is started.

Specifically, during normal heating, the control valve assembly controls the heating pipeline 5 to be closed off, so that the coolant is prevented from flowing through the heating pipeline 5. Additionally, the first circulation pipeline 2 is opened through, and the coolant normally starts from the air conditioner indoor unit 1, flows through the coolant heat radiation module 31 and the fins 32 to perform heat exchange, and then flows back into the air conditioner indoor unit 1. During defrosting, the control valve assembly controls the heating pipeline 5 to be closed off to make a part of coolant to flow through the heating pipeline 5. Additionally, the control valve assembly controls the first circulation pipeline 2 to reduce the flow rate flowing through, a part of coolant normally starts from the air conditioner indoor unit 1 through the first circulation pipeline 2, flows through the coolant heat radiation module 31 and the fins 32 to perform heat exchange, and then flows back into the air conditioner indoor unit 1, the other part of coolant passes through the heating pipeline 5, and is heated by the heating assembly 4 in the heating pipeline 5 to form a high-temperature coolant, the high-temperature coolant flows into the fins 32 for heat radiation, to achieve a fast defrosting effect. The coolant after heat radiation and the coolant in the first circulation pipeline 2 return to the air conditioner indoor unit 1 through the return pipe 23.

The present invention has the beneficial effects that the exchange system for the outdoor unit of the air conditioner controls the opened-closed states of the first circulation pipeline 2 and the heating pipeline 5 through the control valve assembly, by cooperating with the heating assembly 4, it is possible to provide high-temperature coolant for the fins 32 in the heating process. A better defrosting effect can be achieved while ensuring the heating effect. It can eliminate the need for frequently reversing the compressor. The technical problem of damaging user experience and shortening service life of the air conditioner due to frequent reversing the compressor in the prior art can be solved. The high-temperature coolant flows into the outdoor unit after heating and thus avoids a module which may most easily trigger a high-temperature warning, so that a machine halt risk due to triggering a high-temperature warning can be reduced. A highest temperature of the coolant at an outlet of the heating assembly 4 does not need to be limited, and heat in the heating assembly 4 can be sufficiently utilized. The coolant flowing into the air conditioner outdoor unit does not need to be limited to a highest temperature, the defrosting effect can be well improved, and the time for defrosting can be reduced. The control on the coolant can be eliminated, the coolant after defrosting can remain sufficient heat for indoor unit heat exchange, and the system stability during heating can be improved.

It shall be noted that the heating assembly 4 in the present embodiment is a phase-change heat storage box, which has an advantage of constant temperature and great heat storage density.

It shall be noted that in some embodiments, the control valve assembly is controlled by the controller, the controller sends a control signal, and the control valve assembly can be controlled to realize the control on the opened-closed state of the first circulation pipeline 2 and the heating pipeline 5.

It shall be noted that in some embodiments, in a communication position of the heating pipeline 5 and the output pipe 21, a diameter of the output pipe 21 is greater than a diameter of the heating pipeline 5, which is favorable to ensure sufficient coolant in the first circulation pipeline 2 in the defrosting process, and ensure the heating effect.

Further, referring to FIG. 1 in some embodiments, the control valve assembly includes a first valve 61 and a second valve 62. The first valve 61 is connected with the output pipe 21 and is configured to control an opened-closed state of the output pipe 21. The second valve 62 is connected with the heating pipeline 5 and is configured to control an opened-closed state of the heating pipeline 5. One end of the connecting pipe 22 is connected with the coolant heat radiation module 31, the other end of the connecting pipe 22 is connected with the heating pipeline 5, the connecting pipe 22 communicates with the fins 32 through the heating pipeline 5, and the heating pipeline 5 communicates with the return pipe 23 through the fins 32.

Specifically, during normal heating, the first valve 61 is completely opened, the second valve 62 is closed, the coolant normally starts from the air conditioner indoor unit 1, flows through the coolant heat radiation module 31 and the fins 32 to perform heat exchange, and then flows back into the air conditioner indoor unit 1. During defrosting, the first valve 61 is properly and partially opened, the second valve 62 is opened, a part of coolant normally starts from the air conditioner indoor unit 1 through the circulation pipeline 2, flows through the coolant heat radiation module 31 and the fins 32 to perform heat exchange, and then flows back into the air conditioner indoor unit 1, the other part of coolant passes through the heating pipeline 5 to form a high-temperature coolant after being heated by the heating assembly 4 in the heating pipeline 5, the high-temperature coolant flows into the fins 32 for heat radiation, to achieve a fast defrosting effect. The coolant after heat radiation and the coolant in the first circulation pipeline 2 return to the air conditioner indoor unit 1 through the return pipe 23.

Further, the heating assembly 4 is connected between the second valve 62 and the fins 32. The coolant forms the high-temperature coolant after being heated while flowing through the heating assembly 4.

Further, the first valve 61 and the second valve 62 are stop valves. The valves have an excellent sealing effect when being closed.

Further, referring to FIG. 2, in some embodiments, the control valve assembly includes a third valve 63. The third valve 63 is connected with the output pipe 21 and the heating pipeline 5 at the same time, and the third valve 63 respectively controls opened-closed states of the output pipe 21 and the heating pipeline 5.

Specifically, during normal heating, the third valve 63 controls the output pipe 21 to be opened through, and the heating pipeline 5 is blocked. The coolant normally starts from the air conditioner indoor unit 1, flows through the coolant heat radiation module 31 and the fins 32 to perform heat exchange, and then flows back into the air conditioner indoor unit 1. During defrosting, an outlet portion of the third valve 63 communicating with the output pipe 21 is opened, the output pipe 21 is opened through, the heating pipeline 5 is controlled to be opened through, a part of coolant normally starts from the air conditioner indoor unit 1 through the first circulation pipeline 2, flows through the coolant heat radiation module 31 and the fins 32 to perform heat exchange, and then flows back into the air conditioner indoor unit 1, the other part of coolant passes through the heating pipeline 5 to form a high-temperature coolant after being heated by the heating assembly 4 in the heating pipeline 5, the high-temperature coolant flows into the fins 32 for heat radiation, to achieve a fast defrosting effect. The coolant after heat radiation and the coolant in the first circulation pipeline 2 return to the air conditioner indoor unit 1 through the return pipe 23.

Further, the heating pipeline 5 includes a first heating pipeline 51, a cooling connecting pipeline 52 and a cooling refluxing pipeline 53. The first heating pipeline 51 communicates with the third valve 63 and the fins 32. The first heating pipeline 51 communicates with the cooling connecting pipeline 52 through the fins 32. The cooling connecting pipeline 52 communicates with the fins 32 and the coolant heat radiation module 31. The cooling connecting pipeline 52 communicates with the cooling refluxing pipeline 53 through the coolant heat radiation module 31. The cooling refluxing pipeline 53 communicates with the coolant heat radiation module 31 and the return pipe 23.

Specifically, during defrosting, a part of coolant normally starts from the air conditioner indoor unit 1 through the first circulation pipeline 2, flows through the coolant heat radiation module 31 and the fins 32 to perform heat exchange, and then flows back into the air conditioner indoor unit 1, the other part of coolant passes through the first heating pipeline 51 to flow into the fins 32, and is heated by the heating assembly 4 in the first heating pipeline 51 before flowing into the fins 32 to form a high-temperature coolant, the high-temperature coolant flows into the fins 32 for heat radiation, to achieve a fast defrosting effect. Then, the coolant after heat radiation enters the coolant heat radiation module 31 through the cooling connecting pipeline 52 to perform heat exchange, and then flows into the return pipe 23 through the cooling refluxing pipeline 53. The heating pipeline 5 and the first heating pipeline 51 are independent from each other at the coolant heat radiation module 31 and the fins 32, the mutual interference of the coolant in the heating pipeline 5 and the first heating pipeline 51 at the coolant heat radiation module 31 and the fins 32 is small, and the heating function stability can be ensured.

Further, the exchange system for the outdoor unit of the air conditioner further includes a fourth valve 8. The cooling refluxing pipeline 53 communicates with the return pipe 23 through the fourth valve 8, and the fourth valve 8 controls an opened-closed state of the cooling refluxing pipeline 53. Through the fourth valve 8, during normal heating, the cooling refluxing pipeline 53 can be closed off to prevent the coolant in the return pipe 23 from refluxing.

Further, the fourth valve 8 is a reversing valve.

Further, the third valve 63 is a reversing valve. The reversing valve has the advantages of accurate action, high automation degree, and high work stability and reliability, and is applicable to the exchange system for the outdoor unit of the air conditioner.

The present invention further provides an air conditioner including a controller, an air conditioner indoor unit 1, an air conditioner outdoor unit 7 and the exchange system for the outdoor unit of the air conditioner. The controller is in communicative connection with and controls the control valve assembly; the outdoor unit heat exchange assembly 3 is included in the outdoor unit; and the indoor unit includes a pressure pump, an output end of the pressure pump communicates with the output pipe 21, and an input end of the pressure pump communicates with the return pipe 23. Therefore, the air conditioner also achieves the better defrosting effect while ensuring the heating effect. It can eliminate the need for frequently reversing the compressor. The technical problem of damaging user experience and shortening service life of the air conditioner due to frequent reversing of the compressor in the prior art can be solved.

The present invention has the beneficial effects that the exchange system for the outdoor unit of the air conditioner controls the opened-closed states of the first circulation pipeline 2 and the heating pipeline 5 through the control valve assembly, by cooperating with the heating assembly 4, it is possible to provide a high-temperature coolant for the fins 32 in the heating process, and it can achieve a better defrosting effect while ensuring a heating effect, and can eliminate the need for frequently reversing the compressor. The technical problem of damaging user experience and shortening service life of the air conditioner due to frequent reversing of the compressor in the prior art can be solved.

The above descriptions are only exemplary embodiments of the present invention, and thus do not limit the scope of the present invention. Equivalent structures or equivalent flow process transformations made according to the description and the accompanying drawings of the present invention, or direct or indirect applications to other related technical fields all fall within the protection scope of the present invention.

What is claimed is:

1. A heat exchange system for an outdoor unit of an air conditioner, comprising:

an outdoor unit heat exchange assembly comprising a coolant heat radiation module and fins;

a first circulation pipeline comprising an output pipe, a connecting pipe and a return pipe, wherein the output pipe communicates with an air conditioner indoor unit and the coolant heat radiation module, the connecting pipe communicates with the coolant heat radiation module and the fins, and the return pipe communicates with the fins and the air conditioner indoor unit;

a control valve assembly connected with the output pipe and controlling an opened-closed state of the first circulation pipeline;

a heating pipeline communicating with the output pipe and the fins, and further connected with the control valve assembly, wherein the control valve assembly controls an opened-closed state of the heating pipeline; and a heating assembly connected with the heating pipeline and configured to heat a coolant in the heating pipeline before entering the fins, wherein in a heating process, the first circulation pipeline is opened through, and in a defrosting process, the first circulation pipeline and the heating pipeline are both opened through, and the heating assembly is started;

wherein the control valve assembly comprises:

a first valve connected with the output pipe and configured to control an opened-closed state of the output pipe; and a second valve connected with the heating pipeline and configured to control an opened-closed state of the heating pipeline; and one end of the connecting pipe is connected with the coolant heat radiation module, the other end of the connecting pipe is connected with the heating pipeline, the connecting pipe communicates with the fins through the heating pipeline, and the heating pipeline communicates with the return pipe through the fins;

wherein the heating assembly is connected between the second valve and the fins.

2. The exchange system for the outdoor unit of the air conditioner according to claim 1, wherein the first valve and the second valve are stop valves.

3. The exchange system for the outdoor unit of the air conditioner according to claim 1, wherein the control valve assembly comprises:

a third valve connected with the output pipe and the heating pipeline at the same time and configured to respectively control opened-closed states of the output pipe and the heating pipeline.

4. The exchange system for the outdoor unit of the air conditioner according to claim 3, wherein the third valve is a reversing valve.

5. An air conditioner, comprising a controller, an air conditioner indoor unit, an air conditioner outdoor unit and the exchange system for the outdoor unit of the air conditioner according to claim 1, wherein the controller is in communicative connection with and controls the control valve assembly;

the outdoor unit heat exchange assembly is comprised in the outdoor unit; and the indoor unit comprises a pressure pump, an output end of the pressure pump communicates with the output pipe, and an input end of the pressure pump communicates with the return pipe.

6. A heat exchange system for an outdoor unit of an air conditioner, comprising:

an outdoor unit heat exchange assembly comprising a coolant heat radiation module and fins;

a first circulation pipeline comprising an output pipe, a connecting pipe and a return pipe, wherein the output pipe communicates with an air conditioner indoor unit and the coolant heat radiation module, the connecting pipe communicates with the coolant heat radiation module and the fins, and the return pipe communicates with the fins and the air conditioner indoor unit;

a control valve assembly connected with the output pipe and controlling an opened-closed state of the first circulation pipeline;

a heating pipeline communicating with the output pipe and the fins, and further connected with the control valve assembly, wherein the control valve assembly controls an opened-closed state of the heating pipeline; and a heating assembly connected with the heating pipeline and configured to heat a coolant in the heating pipeline before entering the fins, wherein in a heating process, the first circulation pipeline is opened through, and in a defrosting process, the first circulation pipeline and the heating pipeline are both opened through, and the heating assembly is started;

wherein the control valve assembly comprises:

a third valve connected with the output pipe and the heating pipeline at the same time and configured to respectively control opened-closed states of the output pipe and the heating pipeline;

wherein the heating pipeline comprises a first heating pipeline, a cooling connecting pipeline and a cooling refluxing pipeline;

the first heating pipeline communicates with the third valve and the fins; the first heating pipeline communicates with the cooling connecting pipeline through the fins; the cooling connecting pipeline communicates with the fins and the coolant heat radiation module; the cooling connecting pipeline communicates with the cooling refluxing pipeline through the coolant heat radiation module; and the cooling refluxing pipeline communicates with the coolant heat radiation module and the return pipe.

7. The exchange system for the outdoor unit of the air conditioner according to claim 6, further comprising a fourth valve, wherein the cooling refluxing pipeline communicates with the return pipe through the fourth valve, and the fourth valve controls an opened-closed state of the cooling refluxing pipeline.

8. The exchange system for the outdoor unit of the air conditioner according to claim 7, wherein the fourth valve is a reversing valve.

* * * * *